United States Patent [19]

Tracy

[11] Patent Number: 4,714,226

[45] Date of Patent: Dec. 22, 1987

[54] METHOD AND APPARATUS FOR MOUNTING A DAVIT ON A ROOF STRUCTURE

[75] Inventor: Stephen E. Tracy, Seattle, Wash.

[73] Assignee: Spider Staging, Inc., Renton, Wash.

[21] Appl. No.: 877,807

[22] Filed: Jun. 24, 1986

[51] Int. Cl.[4] ..... F16M 13/00

[52] U.S. Cl. ..... 240/544; 182/142; 248/507

[58] Field of Search ..... 248/544, 673, 678, 679, 248/680, 681, 154, 222.1–222.3, 224.4, 223.4, 346, 500, 507–509, 503.1, 205.1; 182/142, 45, 150; 52/707, 704, 698

[56] References Cited

U.S. PATENT DOCUMENTS

| | | | |
|---|---|---|---|
| 1,385,765 | 7/1921 | Wells | 52/707 |
| 3,550,343 | 12/1970 | Buske | 52/704 |
| 3,601,432 | 8/1971 | Fenwick | 248/222.1 |
| 4,455,046 | 6/1984 | Linderoth | 248/503.1 |
| 4,538,705 | 9/1985 | Leivestad | 182/142 |
| 4,545,558 | 10/1985 | Crudele | 248/544 |
| 4,590,732 | 5/1986 | Hallman | 52/704 |
| 4,598,524 | 7/1986 | Cheng | 248/544 |

*Primary Examiner*—Ramon S. Britts
*Assistant Examiner*—A. Chin-Shue
*Attorney, Agent, or Firm*—Delbert J. Barnard

[57] ABSTRACT

A swivel housing (22) at the lower end of a davit (10) is introduced into an open side of a socket (20). The socket (20) is mobile and it includes hook members (136, 140) at its lower end which fit through openings (60, 62) in a base member (18) which is incorporated into a rooftop (12). The socket (20) is then slid sideways to place the hook members (136, 140) below hook engaging portions (90, 94 or 92, 96) of a top wall (56) of the base member (18). Then, a filler member (146) is inserted into a portion of the opening (60, 62) which is vacated by the sideways shifting of the socket (20), to block unwanted sideways shifting of the socket (20) in opposite direction. The swivel housing (22) at the lower end of the davit (10) is inserted into the open side of the socket (20) while the davit is in a horizontal position. Then, a pivot pin (188) is inserted and the davit (10) is swung upwardly about the pivot pin (188). Then, a lock pin (196) is inserted to lock the davit (10) in an upright position.

22 Claims, 21 Drawing Figures

METHOD AND APPARATUS FOR MOUNTING A DAVIT ON A ROOF STRUCTURE

DESCRIPTION

1. Technical Field

This invention relates to a method and apparatus for mounting and dismounting a davit on a roof structure and, more particularly, to such a method and apparatus which provides a sure mount of the davit when the davit is needed and a flush surface at the location of davit mount during those times that the davit is not in use but is in storage.

2. Background Art

U.S. Pat. No. 4,538,705, granted Sept. 3, 1985, to Ole E. Leivestad, discloses the use of a pair of roof davits for supporting a work platform assembly comprising a pair of suspended staging units and a staging platform bridging between the units. In some installations of this type it is possible to permanently mount the davits in position on the rooftop. In other installations it is desirable to remove the davits and put them into storage during those periods when the platform assembly is not being used. One prior art system for providing a removable davit is disclosed by U.S. Pat. No. 4,545,558, granted Oct. 8, 1985 to Richard E. Crudele. In accordance with the system of this patent, a socket is transported to the site of an elevated pedestal on a roof and is secured to the pedestal. The davit is inserted into the open upper end of the socket. Reference is made to this patent for a description of the construction and use of the apparatus.

Spider Staging, Inc. of Renton, Washington makes a portable socket which is also connectable to an elevated pedestal. This socket includes fixed position wheels which are used for trundling the socket to and from the pedestal. A tongue extends laterally from the socket. A first overhanging edge portion of the pedestal is received between this tongue and the bottom of the socket. Then a lock pin is extended through openings in a pair of ears which depend from the socket at a location which places the lock pin below a second overhanging edge portion of the pedestal.

There is a need for providing a way of mounting a mobile socket on a rooftop without using an elevated pedestal. There are some roofs which are used as activity regions, i.e. penthouse patios, rooftop restaurants and/or bars, rooftop walkways, etc., in which the presence of a pedestal is objectionable. A principal object of the present invention is to provide a system for mounting a davit socket which does not include a pedestal but which during periods of davit storage provides at the socket mounting location, a surface which is substantially flush with the rooftop.

DISCLOSURE OF THE INVENTION

The davit mount of the present invention is basically characterized by a base member formed to include a pair of spaced apart first and second hook receiving openings, and hook engaging portions bordering the hook receiving openings. A mobile davit socket is provided which comprises first and second sidewalls spaced opposite each other. A third sidewall is interconnected between the first and second sidewalls. The socket includes a bottom which may or may not be open and includes an open top. The fourth side of the socket is open.

The socket includes first hook means depending from one side of the socket and second hook means depending from the opposite side of the socket. The first hook means includes a first end wall which extends downwardly from the socket and a first hook member which extends laterally from the first end wall. The second hook means includes a second end wall which extends downwardly from the socket and a second hook member which extends laterally from the second end wall in the same direction as the first hook member.

The hook receiving openings in the base member are sized and shaped to receive the hook members when the hook members are aligned with the hook receiving openings. This enables the davit socket to be transported to the base member and the hook members be put into alignment with the hook receiving openings in a base member, followed by movement of the socket to insert the hook members through the hook receiving openings. Then the socket is shifted sideways in the direction the hook members extends, to place the hook members below the hook engaging portions of the base member. The socket is secured in said shifted position by inserting a filler member into the hook receiving opening on the trailing side of the socket, in a position to block a shifting movement of the socket back into a position in which the hook members are in removal alignment with the hook receiving openings.

In preferred form, the base member has a substantially flat upper surface, so that in use the base member can be imbedded into a structure with the upper surface substantially flush with a surrounding upper surface portion of the structure, e.g. a roof surface which is also utilized as a floor or walkway. The base member may include a border portion which extends about the periphery of the base member and projects upwardly above the upper surface, so that a cover plate sized to fit within the border portion, and of a thickness substantially equal to the height of the border portion, can be placed on the base member to cover the openings.

In preferred form, the filler member is attached to a swing member which is located between the first and second sidewalls of the socket and at one end is pivotally mounted to the socket, for swinging movement between an up position in which it is adjacent the third wall of the socket and a down position in which it extends substantially horizontally and places the filler member into the opening which trails sideways shifting movement of the socket.

The method of the present invention is basically characterized by providing a rooftop with a base member having an upper surface set to be substantially flush with the portion of the rooftop surrounding the base member. This base member is provided with a pair of spaced apart first and second hook openings and hook engaging portions bordering the hook receiving openings. A mobile davit socket is provided which has first and second sidewalls spaced opposite each other. A third sidewall is provided to interconnect between the first and second sidewalls. The socket is provided with a bottom which may be opened or closed and is provided with an open top and an open fourth side. It is further provided with first hook means depending from the fourth side of the socket and including a first end wall which extends downwardly from the socket and a first hook member which extends laterally from the first end wall, towards the socket. The socket is further provided with second hook means depending from the third sidewall side of the socket and including a second end wall which extends downwardly from the socket and a second hook member which extends laterally from the second end wall in the same direction as the first hook member, and away from the socket. A davit is provided which includes a lower end portion sized to be received within the socket. The mobile davit socket is carried to the base member. It is then orientated to place the hook members which are on the mobile davit socket into alignment with the hook receiving openings in the base member. The socket is then moved to insert the hook members through the hook receiving openings. Then the socket is shifted sideways in the direction that the hook members extend, to place the hook members below the hook engaging portions of the base member. This shifting movement of the socket exposes a substantial portion of the opening in the base member on the trailing side of the socket. The socket is then locked into the shifted position so that it will not shift back into a position in which the hook members are in removal alignment with the hook receiving openings. In preferred form this is done by inserting a filler camber into the opening on the trailing side of the socket.

Next the davit is brought to the davit socket. The lower end of the davit is placed into the socket, through the open fourth side of the socket. Then, the davit is swung upwardly into an upright position in the socket and the davit is secured to the socket so that it will remain in said upright position.

Other more detailed aspects of both the apparatus and method of the invention are described below as a part of the description of the best mode of the invention, and are pointed out with particularity in the claims.

BEST MODE FOR CARRYING OUT THE INVENTION

Figure 1:
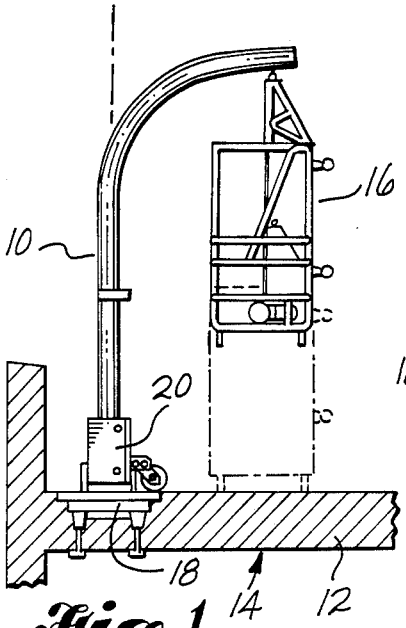
FIG. 1 is an elevational view of a davit mounted onto a building roof and turned inwardly, and showing a staging unit suspended from the davit.

The drawing shows apparatus that is constructed according to the invention and that also constitutes the best mode of the apparatus of the invention currently known to the applicant. The drawings also illustrate the best mode of the method of the invention currently known to the applicant.

Figure 2:
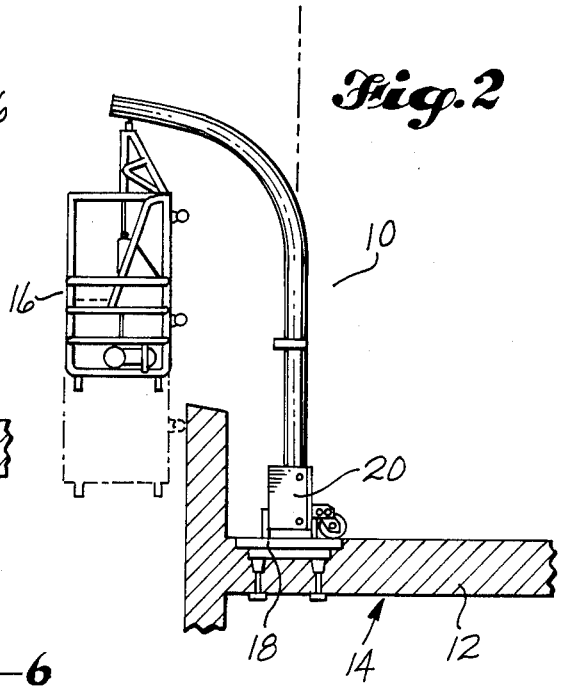
FIG. 2 is a view like FIG. 1, but showing the davit swung outwardly to place the suspended staging unit in a position outboard of the building, so that it can be raised and lowered along side of the building.

FIGS. 1 and 2 show a davit 10 mounted on a rooftop 12 of a building 14, for rotation between an inboard position (FIG. 1) and an outboard position (FIG. 2). The purpose of the davit 10 is to provide a support for the end of a suspension for a suspended staging unit 16. Staging unit 16 may be of the type disclosed in U.S. Pat. No. 2,998,094, granted Aug. 29, 1961 to Sidney L. Fisher. A typical operation of the davit 10 is described in U.S. Pat. No. 4,438,705, granted Sept. 3, 1985 to Ole F. Leivestad. The contents of both of these patents is incorporated herein by reference.

The davit mount of the present invention comprises a base member 18 which is incorporated into the upper surface of the roof 12, and mobile davit socket 20. As will hereinafter be explained, the davit 10 is removably mounted in the socket 20 and the socket 20 is removably mounted onto the base member 18.

Figure 7:
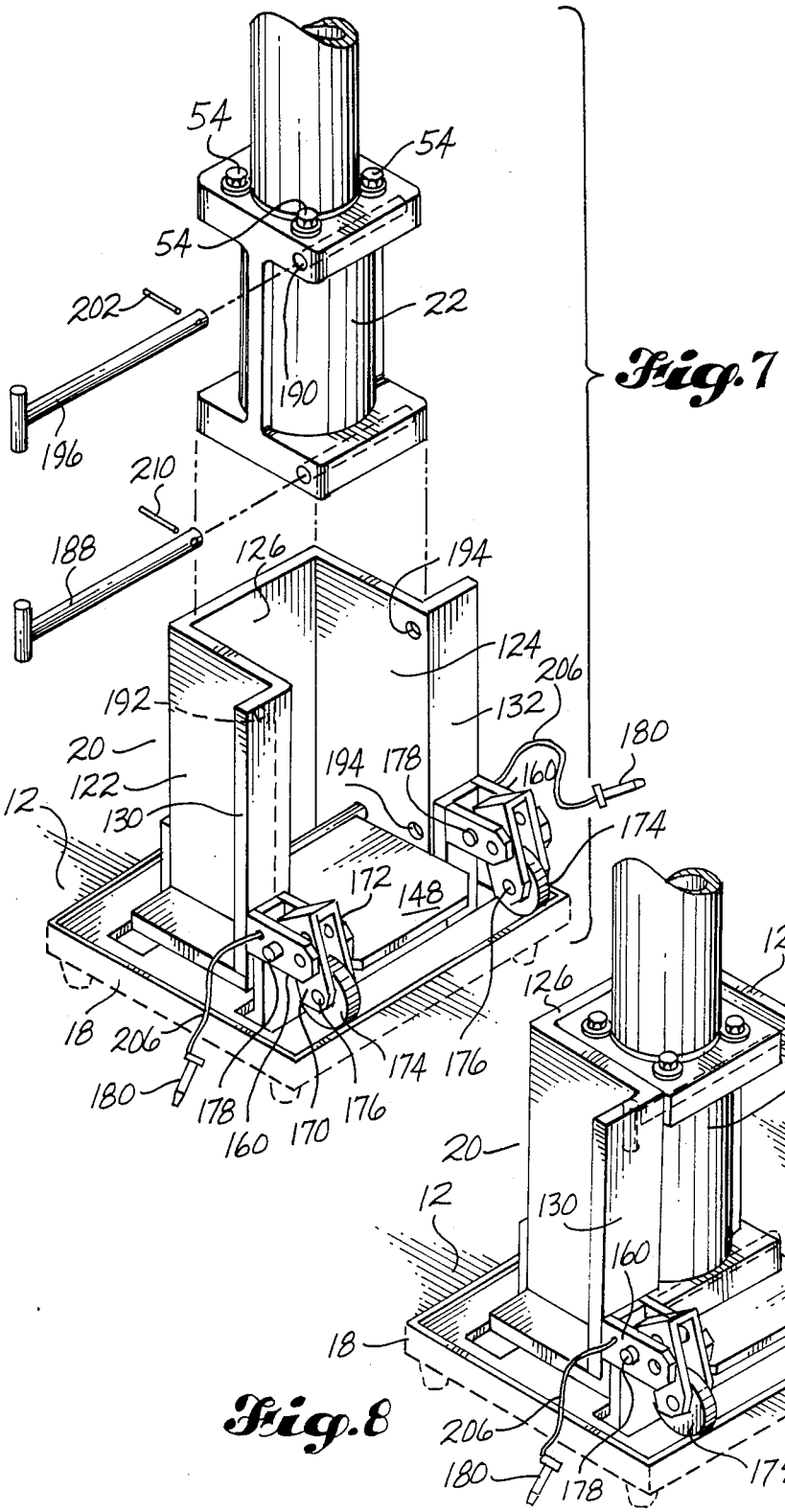
FIG. 7 is an exploded isometric view of the preferred embodiment of the invention, such view showing a lower portion of the davit spaced above an open sided mobile socket which is shown spaced above the base member.
Figure 8:
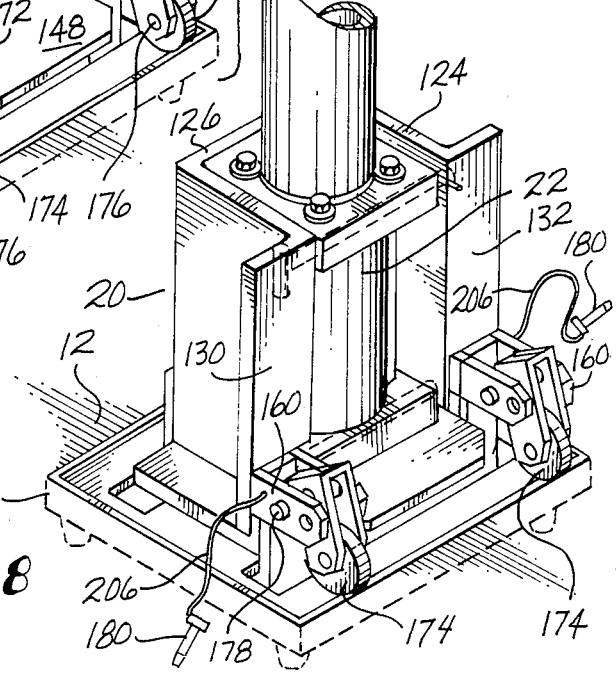
FIG. 8 is a view like FIG. 7, but showing the lower portion of the davit secured within the socket and showing the socket secured to the base member.
Figure 9:
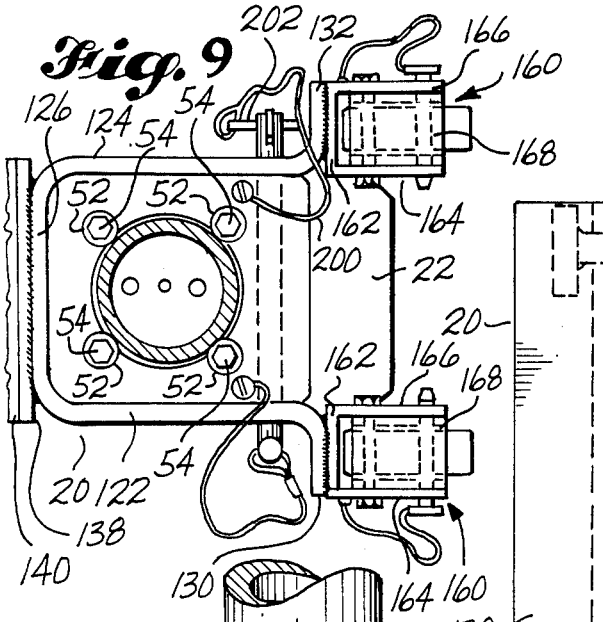
FIG. 9 is a sectional view taken through the davit, presenting a top plan view of a swivel housing at the lower end of the davit and a top plan view of the davit socket.
Figure 21:
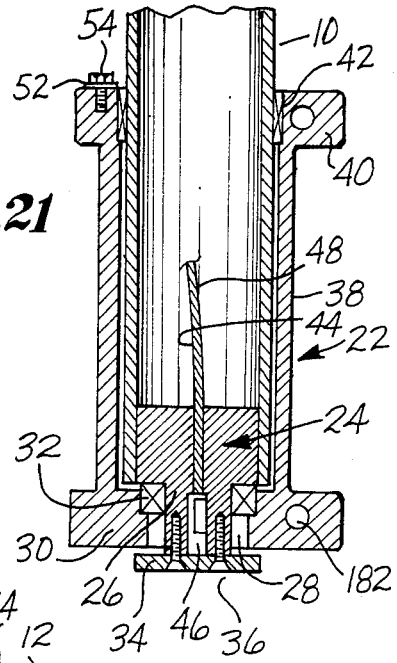
FIG. 21 is a vertical sectional view of the lower portion of the davit.

As best shown by FIGS. 7–9, the lower end portion of the davit 10 carries a swivel housing 22. Davit 10 is preferably constructed from metal tubing. As illustrated in FIG. 21, an end piece 24 is secured into the lower end of the davit 10. End piece 24 has an inner portion which is sized to be snugly received within the lower end portion of the davit 10, and a smaller diameter portion 26 which projects downwardly below the end of the davit 10. When the lower end portion of the davit 10 is within the swivel housing 22, the lower end portion 26 of end member 24 extends through an opening 28 in the lower end 30 of the housing 22. End portion 26 also extends through a bearing 32 which is situated in a bearing socket formed in an inner portion of the housing lower end 30. A retention plate 34 is connected to the end member 22. As illustrated, plate 34 is placed into contact with the lower end surface of end portion 26, and is secured into place by a plurality of screw fasteners 36. Plate 34 is larger in diameter than the opening 28.

As a result, it prevents the housing 22 from falling off the davit 10 during transportation of the davit 10.

Housing 22 is vertically elongated and in a typical installation may measure about two feet in length. It comprises a tubular sidewall 38, an upper end 40 and the aforementioned lower end 30. The transverse configuration of the upper and lower ends 40, 30 substantially conforms to the inside configuration of the socket 20 (FIG. 9). A bushing socket is formed in the upper portion of the upper end flange 40, to receive a bushing 42. As should be evident, the bearing 32 and the bushing 42 support the davit 10 for rotation within the swivel housing 22.

A center passageway 44 extends axially through the end member 24. A larger diameter socket 46 is formed in the lower end of end portion 26, coaxial with the passageway 44. A wire rope or cable 48 extends through the passageway 44. An end member 50, which is larger in diameter than passageway 44, is swaged onto the lower end of the wire rope 48. This member 50 is received within the socket 48, and effectively secures the lower end of the wire rope 48 to the lower end of the davit 10. Wire rope 48 then extends upwardly through the davit 10 and becomes a part of the suspension system for the staging 16.

The bushing 42 may be easily secured in place by the employment of a plurality of fenders 52 spaced about the upper end of the socket 22 and secured to the end portion 40 by means of a plurality of bolts 54. The fenders 52 are constructed to overlap the upper end of the bushing 42.

Figure 3:
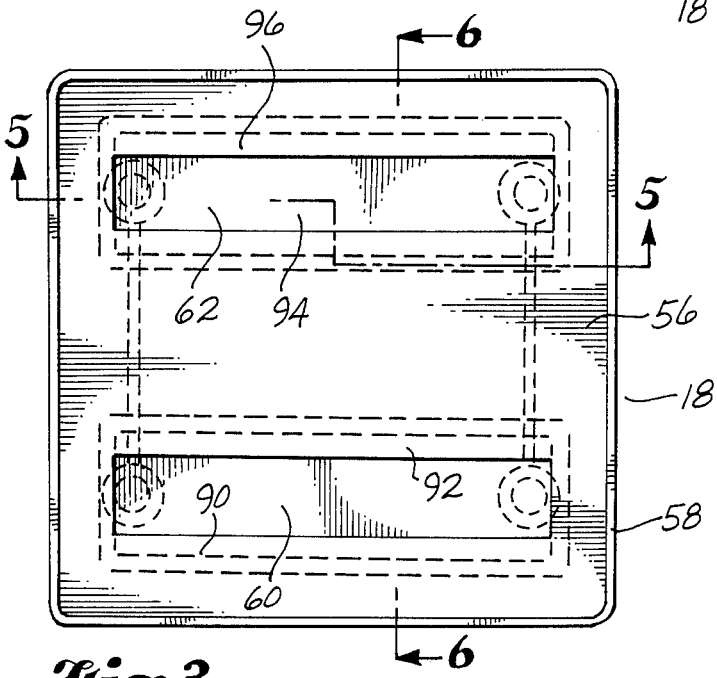
FIG. 3 is a top plan view of a base member portion of a preferred embodiment of the invention.
Figure 5:
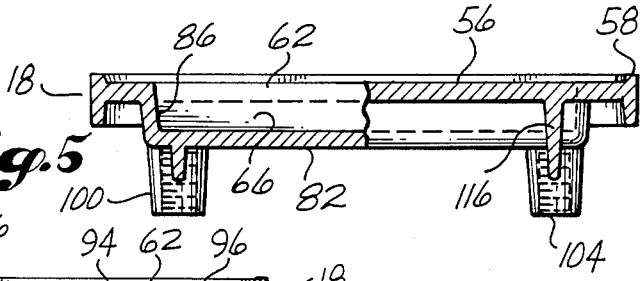
FIG. 5 is a sectional view taken substantially along line 5—5 of FIG. 3.

The base member 18 may be of cast construction. In preferred form, it comprises a top wall 56 bordered by an upstanding rim 58 (FIGS. 3 and 5). A pair of laterally spaced apart openings 60, 62 are formed in the top wall 56. Preferably, these openings 60, 62 are rectangular in shape and are substantially longer than they are wide. By way of example, the openings may measure about two and one half inches in width by about fourteen inches in length.

Figure 6:
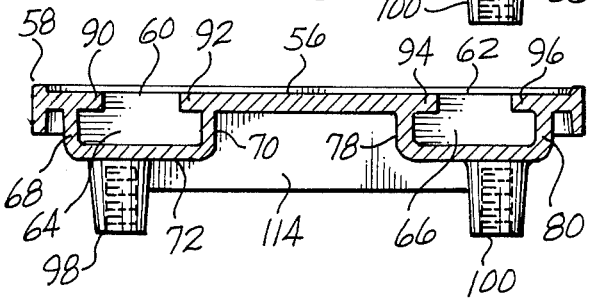
FIG. 6 is a sectional view taken substantially along line 6—6 of FIG. 3.

The openings 60, 62 open into compartments 64, 66 which are below wall 56 and are closed except for the openings 60, 62. Compartment 64 is shown to comprise a pair of sidewalls 68, 70, a bottom wall 72 and a pair of end walls 74, 76. In similar fashion, compartment 66 comprises a pair of sidewalls 78, 80, a bottom wall 82 and a pair of end walls 84, 86. As shown by FIG. 6, the compartments 64, 66 are wider than the openings 60, 62. This results in a portion of the top wall 56 bordering each side of each opening 60. Referring to FIG. 6, these border portions are designated 90, 92, 94, 96. These border portions 90, 92, 94, 96, will hereinafter sometimes be referred to as the hook engaging portions of the base member 18.

Figure 4:
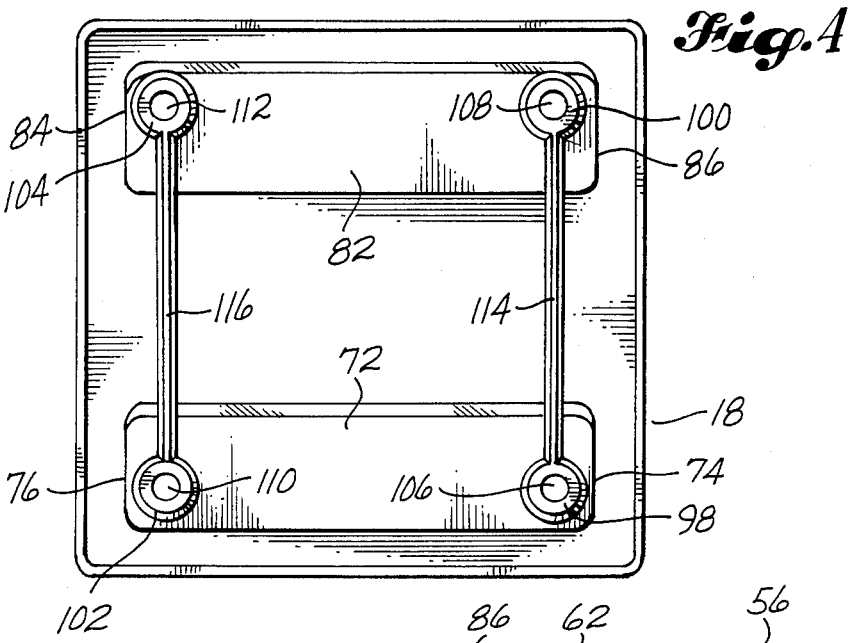
FIG. 4 is a bottom plan view of the base member shown by FIG. 3.

In preferred form, base member 18 is formed to include a plurality of fastener sockets 98, 100, 102, 104. As shown by FIGS. 4 and 6, these sockets may be integral extensions of lower corner portions of the compartment bottoms 72, 82. The compartment walls and bottom strengthen the member 18 in the direction of elongation of the openings 60, 62.

The sockets 98, 100, 102, 104 include threaded bolt receiving openings 106, 108, 110, 112 which are each positioned to receive the threaded end of a bolt extending upwardly from a frame structure in the roof situated below the upper surface of the roof. Reinforcing ribs 114, 116 may be cast in the member 18, to extend between the fastener sockets in the transverse direction. As shown by FIG. 4, rib 114 extends between socket 98 and socket 100. Rib 116 extends between socket 102 and socket 104.

In preferred form, the base member 18 is set into the roof so that the upper edge of the rim 58 is substantially flush with the upper surface of the roof where it immediately surrounds the base member 18. During periods when the davit 10 is not being used, and the davit 10 and the socket 20 are disconnected from each other and from the base member 18, and are stored somewhere remote from the base member 18, a cover plate 120 (FIG. 16) may be positioned on the top wall 56, within the confines of the rim 58. Such a cover plate 120 would be sized to snugly fit within the confines of the rim 58, and would be of a thickness substantially equal to the height of the rim 58. It would thus provide a surface above the member 18 which is substantially flush with the roof surface which immediately surrounds the base member 18.

As will hereinafter be described, the socket 20 has an open side which is utilized during installation and removal of the davit 10 from the socket 20. It would not be possible to install or remove the davit 10 if the open end of the socket is orientated outwardly of the building. The construction of the base member 18 to include hook engaging portions 90, 92, 94, 96 on both sides of the two openings 60, 62 allows the base member 18 to be secured to the roof in essentially any orientation, while guaranteeing a way of connecting the socket 20 to the member 18 in such a position that will result in the open side of the socket being accessible in a direction allowing installation and removal of the davit 10. This will hereinafter become more clear during the description of the installation and removal process.

Of course, the provision of a hook engaging portion on both sides of the opening 60, 62 is not necessary for a use of the invention. It is only necessary that each opening 60, 62 include one hook engaging portion and that such hook engaging portions be on the same side of the openings 60, 62. In other words, it is only necessary to have hook engaging portions 90 and 94 or 92 and 96, in order to utilize the invention. If a single set of hook engaging portions is used, orientation of the base member 18 on the roof becomes critical, to avoid a situation which results in the open side of the socket 20 being directed outwardly of the building.

Figure 10:
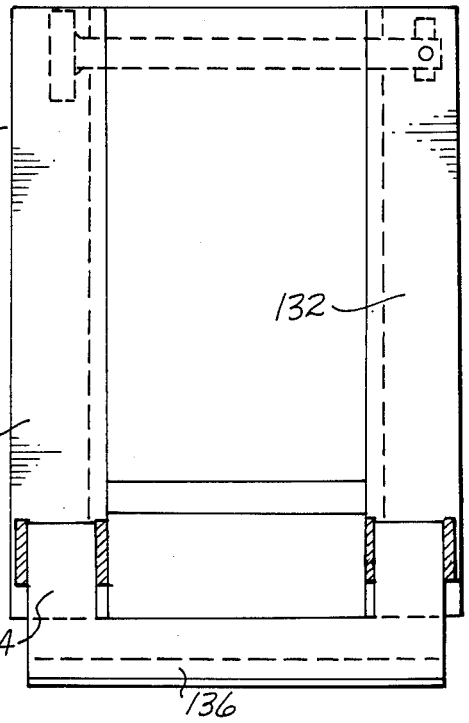
FIG. 10 is a front elevational view of the assembly shown by FIG. 8.
Figure 11:
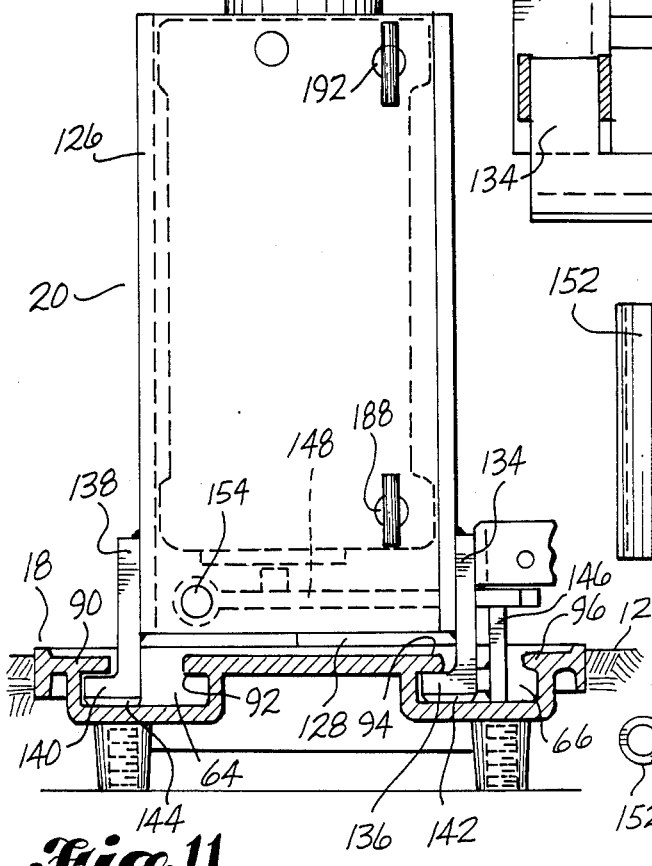
FIG. 11 is a side elevational view of the assembly shown by FIGS. 8 and 10.

Referring to FIGS. 7–11, the socket 20 comprises first and second sidewalls 122, 124, spaced opposite each other, and a third sidewall 126. Sidewall 126 is interconnected between the sidewalls 122, 124 and forms a rounded right angle corner with each of them. The fourth side of the socket 20 and the top of the socket 20 are open. The bottom of the socket 20 may be partially open. As shown by FIG. 11, a bottom wall 128 may extend across the bottom of the socket 20, from a sidewall 122 to a sidewall 124.

Socket 20 may also include outwardly directed flanges 130, 132, flanking the open side of the socket 20.

A pair of hook means depend from the socket. A first hook means includes an end wall 134, the upper portion of which is welded to the flanges 130, 132, and to an edge portion of the bottom member 128 (FIG. 110). The lower portion of end wall 134 extends downwardly and is connected to a first hook member 136 which extends laterally from the first end wall 134. End wall 134 and hook member 136 may be separate leg portions of a length of angle iron, as shown by FIG. 11. As shown by FIG. 10, the upper central portion of end wall 34 is cut out in the region of the open side of the socket.

The second hook means may also be constructed from a length of angle iron. It is shown (FIG. 11) to include an end wall 138 and a hook member 140. End wall 138 is hereinafter sometimes referred to as the second end wall and hook member 140 is hereinafter sometimes referred to as the second hook member.

Figure 14:
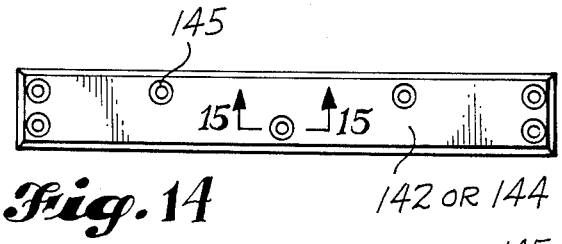
FIG. 14 is a fragmentary bottom plan view of a hook member which is at the lower end of the socket.
Figure 15:
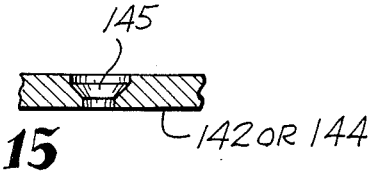
FIG. 15 is a sectional view taken substantially along line 15—15 of FIG. 14.

Preferably, a strip of a self-lubricating plastic material 142, 144 is secured to the bottom of each hook member 136, 140. As shown by FIGS. 14 and 15, the pads 142, 144 may be drilled and countersunk to form openings 145 for receiving a flat top screw type fastener. Corresponding openings are drilled into the hook members 136, 140, and are tapped, for receiving the threaded portions of the fasteners. The pads 142, 144 facilitate sliding of the hook members 136, 140, and further function as were assuming members.

Figure 17:
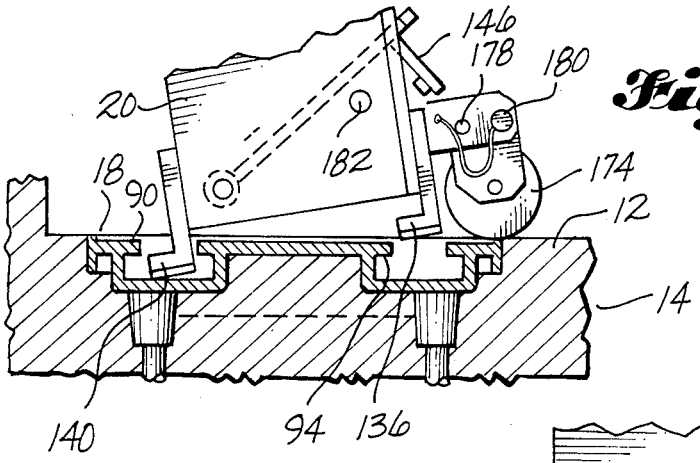
FIG. 17 is a fragmentary view of the lower portion of the socket, showing the hook members being put into alignment with the openings in the base member.
Figure 18:
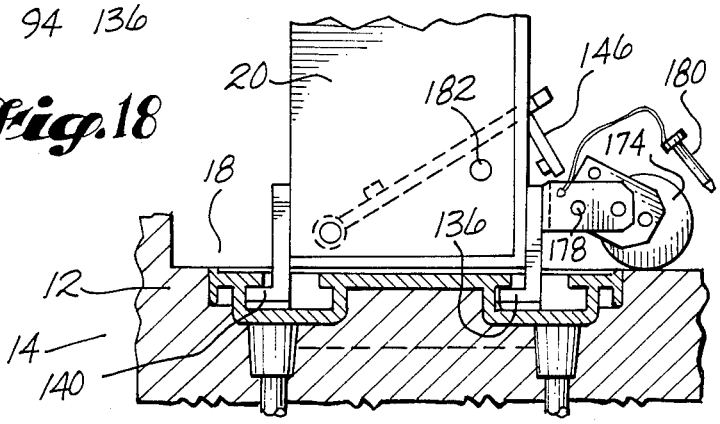
FIG. 18 is a view like FIG. 17, showing a wheel lock pin removed and the wheel swung outwardly, to allow the hook members to drop through the openings.

The hook members 136, 140 are smaller in width than the openings 60, 62. The spacing of the openings 60, 62 is such that when one of the hook members 136, 140 is in alignment with a central portion of one of the openings 60, 62, the other hook member 136, 140 is in alignment with the central portion of the other openings 60, 62. Thus, when the hook members 136, 140 are aligned with the openings 60, 62, the hook members 136, 140 can pass through the openings 60, 62, to place the hook members 136, 140 into the compartments 64, 66 (see FIG. 17).

The depth of each hook member 136, 140, including the pad 142, 144 secured thereto, is slightly smaller than the height of the compartment 64, 66, measured between the floor of the compartment 64, 66 and the under surfaces of the hook engaging portions 90, 92, 94, 96 of the top wall 56. As shown by FIG. 11, after the hook members 136, 140 have been inserted through the openings 60, 62, into the compartments 64, 66, the socket 20 is shifted in position sideways, in the direction of extent of the hook members 136, 140. As shown by FIG. 11, both hook members 136, 140 extend in the same direction. Hook member 136 extends laterally inwardly of its side of the socket (the open side) and hook member 140 extends laterally outwardly from its side of the socket (the side opposite the open side). Referring to FIG. 11, when the socket 20 is shifted in position, in the manner described, the hook members 136, 140 are placed below a pair of hook engaging portions 90, 94, or 92, 96. The particular pair depends upon the direction of orientation of the hook members 136, 140 when inserted into the openings 60, 62.

In FIG. 11 the hook member 136 is shown positioned in compartment 66 and the hook member 140 is shown positioned in the compartment 64. Hook member 136 is below the hook engaging portion 94 and hook member 140 is below the hook engaging portion 90. This shifting of position results in a space existing between the outer surface of end wall 34 and the side edge of opening 62 of which hook engaging portion 96 is a part. In accordance with an aspect of the invention, following the above described shifting in position of the socket 20, a filler member is introduced into that portion of the opening 62 which is between the outer surface of end wall 34 and the edge surface of hook engaging portion 96. This filler member prevents unwanted sliding of the socket 20 back into a position in which the hook members 136, 140 are in registry with the openings 62, 60 respectively, and removal of the socket 20 from the base member 18 is possible.

Figure 12:
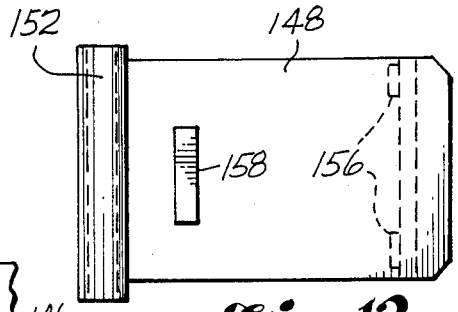
FIG. 12 is a top plan view of a swinging lock member which is a part of the socket and serves to lock the socket in place relative to the base member.
Figure 13:
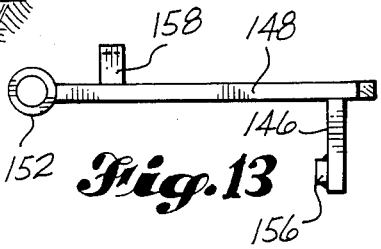
FIG. 13 is a side elevational view of the lock member.

In preferred form, the filler member 146 is connected to one end of a swing member 148. The opposite end of swing member 148 is pivotally connected to lower corner portions of the sidewalls 122, 124, adjacent the sidewall 126. As shown by FIGS. 12 and 13, the swing member 148 may be a rectangular plate of metal to which a short length of tubular material 152 has been welded. Aligned openings are formed in the sidewalls 122, 124 and pin 154 is inserted first through one of these openings, then through the center opening in the length of tubing 152, and then through the second sidewall opening. The pin 154 may have a head at one end and either a cross pin or a nut at its opposite end.

As shown by FIGS. 12 and 13, the filler member 146 may comprise a first rectangular piece of metal welded to the swing member 148, and pads 156 secured to the member 146.

The pin mounted member 148, and the filler member 146 attached thereto, provides what may be referred to as a drop lock. The socket 20 is installed on the base member 18 with the swing member 148 in an upward position. Then, following a shifting of position of the socket 20 relative to the base member 18, to place the hook members 136, 140 below a pair of hook engaging portions 90, 94 or 92, 96, the member 148 is dropped, i.e. it is swung downwardly, to place the filler member 146 into the vacated (by the shifting movement) portion of the opening 62.

Figure 20:
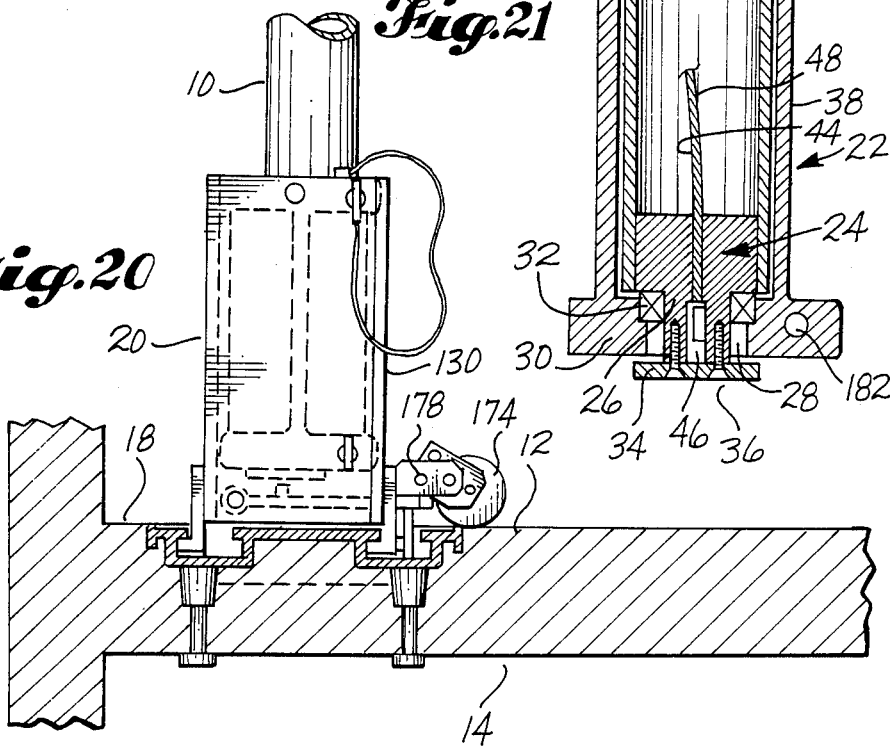
FIG. 20 is a view like FIG. 19, but showing the davit in an upright position and the davit lock pin in place.

A spacer member 158 may be secured to the side of the swing member 148, which forms the top of such member 148 when it is in its down, locked performing position. This spacer member 158 is preferably of such a depth that when the member 148 is in its down position and a davit 10 is in place, the member 158 is adjacent the lower portion 36 of the davit. Upward movement of the member 148 would be arrested by contact between member 158 and portion 36 (FIG. 20).

In preferred form, the socket is provided with a pair of wheel mounting yokes 160, which may be welded to the upper portions of end wall 134 at regions laterally outwardly of the open side of the socket 20. Each yoke 162 comprises a back wall 162 which is welded to the end wall 134 and a pair of sidearms 164, 166 (FIG. 4). Sidearms 164, 166 are parallel to each other and between them receive the upper, closed end portion of a second yoke 168. The second yoke 168 includes a pair of sidearms 170, 172 which are parallel to each other and between which a wheel 174 is received. An axel 176, which may be in the form of a nut and bolt assembly, extends through openings in the sidearms 170, 172 and a center opening in the wheel 174 (FIG. 7).

A pivot pin extends between rearward portions of the arms 164, 166 of the first yoke 160, and also extends through the arms 170, 172 of the second yoke 168. Openings are provided in the two yokes 160, 168 at a location spaced from pivot pin 178. These openings are positioned such that when they are in alignment with each other, and a lock pin 180 is inserted through said openings, the wheel 174 will have a lower portion which extends downwardly below the hook members 136, 140.

Figure 16:
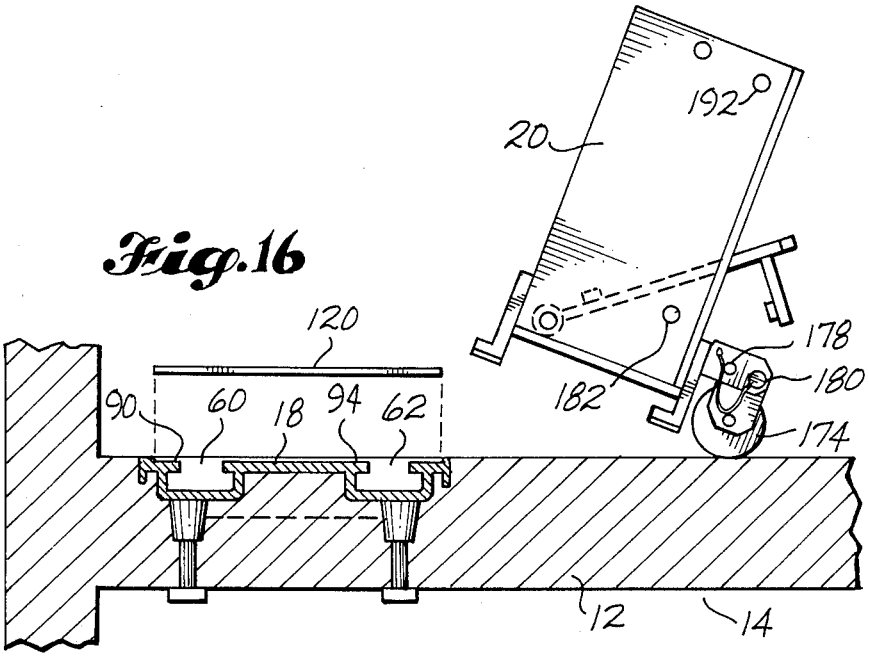
FIG. 16 is a diagramatic view showing the socket being trundled to the location of the base member.

As shown by FIG. 16, the wheels 174 are used for moving the socket 20 to and from the base member 18. The socket 20 may be provided with either a permanent or detachable handle (not shown), by which it may be handled in wheelbarrow fashion.

When the socket 20 has been brought to the base member 18, and the hook members 136, 140 aligned with the openings 60, 62 (or 62, 60), the workmen need only pull the lick pin 180. When this is done, the yoke 168 and the wheel 174 will swing upwardly about the pivot axis established by pivot pin 178, allowing the lock members 136, 140 to settle down into the compartments 64, 66 (or 66, 64). When it is desired to remove the socket from the base member 18, the workmen need only lift the drop lock up out of position, then shift the socket in the direction of the space vacated by the filler member 146, and then tilt the socket 20 in a direction raising yoke 160, and then swing yoke 168 downwardly and reinsert the lock pin 180. The socket 20 can now be tilted in the opposite direction to bring the hook members 136, 140 out through the openings 60, 62 (or 62, 60), and enable the socket 20 to be trundled on the wheels 174 back to its storage place.

Figure 19:
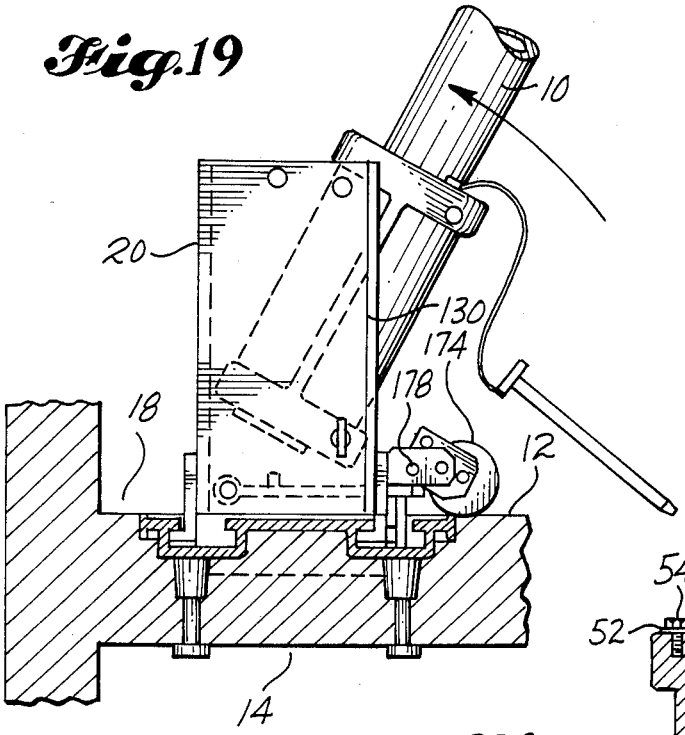
FIG. 19 is a diagramatic view showing the lower end of a davit being placed into the open side of the socket, showing a pivot pin in place, and showing the davit in the process of being swung upwardly.

Referring to FIGS. 19 and 20, after the socket 20 has been secured in place, the davit 10 is carried in a horizontal position to the socket 20. The lower end of the swivel housing 22 is moved into the socket 20, through the open side and the opening 182 is put between and in registry with openings 184, 186 in the socket sidewalls 122, 124. Then, a pivot pin 188 (FIG. 11) is inserted through the aligned openings 182, 184, 186, to pivotally connect the housing 22 to the socket 20. Then, the davit 10 is swung upwardly until the opening 190 in the upper end portion of swivel housing 22 is between and in registry with openings 192, 194 in the socket sidewalls 122, 194. Then, a lock pin 196 is inserted through the aligned openings, to form a couple with the pivot pin 188, which act to hold the davit 10 in an upright position within the socket 20.

The lock pin 196 may be connected by a tether 198 to a portion of the socket 20 (FIG. 9). In similar fashion, a tether 200 may be attached at one end to the housing 22 and the opposite end of the tether 200 may be connected to a cross pin 202. Cross pin 202 extends laterally through the end portion of lock pin 196 which is situated outwardly of wall 124 when the lock pin 196 is installed. Pin 202 prevents unwanted movement of the lock pin 196 out from its lock position. Wheel lock pins 180 may in similar fashion be connected by a tether 206 to a portion of the socket 20, such as the yoke 160. Pivot pin 188 may also be connected to member 22, by means of a tether (not shown). A second cross pin 210 (FIG. 7) may be connected to member 198 by a tether (not shown). Of course, there are numerous other ways that the various pins can be retained or kept in the vicinity of the socket 20.

The davit mount of the invention provides a very secure system for mounting a davit onto a rooftop, for rotation about a vertical axis, and at the same time makes it possible to easily remove and store the davit socket during periods of nonuse. Quite importantly, during periods that the davit and socket are not being used, the socket mount is essentially concealed and becomes a flush portion of the roof surface, enabling its use on roofs which are open to public use, as either a walkway or an activity surface, e.g. open air restaurant use, etc.

It is to be understood that resort is to be made to the following claims and the doctrine of equivalents for a determination of the scope of protection. The embodiment that has been disclosed and described is the best known embodiment known to applicant, but consistant with established rules of patent interpretation, I am not to be limited to the various specifics of the illustrated embodiment.

What is claimed is:

1. A davit mount, comprising a base member formed to include a pair of spaced apart front and rear first and second hook receiving channel openings and hook engaging portions bordering said hook receiving openings;

a mobile davit socket having first and second sidewalls spaced opposite each other, a front wall innerconnected between the first and second sidewalls, a bottom, an open top, and a rear open fourth side first hook means depending from the socket on the rear side of the socket, said first hook means including a first end wall which extends downwardly from the socket, and a first hook member which extends forwardly from said first end wall, and second hook means depending from the front wall of the socket from the said second hook means including a second end wall which extends downwardly from the socket, and a second hook member which extends forwardly from said second end wall in the same direction as the first hook member, said hook receiving openings in the base member being sized and shaped to receive the hook members when such hook members are aligned with said hook receiving openings, so that the davit socket can be transported to the base member and the hook members put into alignment with the hook receiving openings in the base member, and the socket moved to insert the hook members through said hook receiving openings, and then the socket can be shifted forwardly in the direction that the hook members extend, to place the hook members below the hook engaging portions of the base member; and lock means for securing the socket in said shifted position, said lock means including a filler member which is insertable into the hook receiving opening on the trailing side of the socket, in a position to block a shifting movement of the socket back into a position in which the hook members are in removal alignment with the hook receiving openings.

2. A davit mount according to claim 1, wherein the first and second hook receiving openings are substantially rectangular in shape, are long and narrow, and are parallel to each other.

3. A davit mount according to claim 1, wherein said socket includes a pair of flanges extending laterally outwardly from the first and second sidewalls of the socket on the fourth side of the socket.

4. The davit mount according to claim 1, wherein the base member has a substantially flat upper surface, so that in use the base member can be embedded into a structure with said upper surface substantially flush with a surrounding upper surface portion of said structure.

5. A davit mount according to claim 4, wherein the base member includes a lower portion in which bolt receiving holes are formed, so that the base member can be secured to the structure by means of bolts which extend through said holes and connect the base member to said structure.

6. A davit mount according to claim 4, wherein the base member includes a border portion which extends about the periphery of the base member and projects upwardly above said upper surface, said mount further including a cover plate sized to fit within said border portion, said cover plate being of a thickness substantially equal to the height of the border portion above the upper surface of the base member.

7. A davit mount according to claim 1, wherein said lock means comprises a swing member located between the first and second sidewalls, said swing member having first and second ends, and hinge means pivotally connecting the first end of said hinge member to the first and second sidewalls at positions near the bottom and the front wall of the socket, for swinging movement of said swing member between an up position and a down position, said filler member being connected to said swing member at such a position that when the swing member is in its down position the filler member is received in a hook receiving opening in the base member in the manner described.

8. A davit mount according to claim 7, wherein the base member has a substantially flat upper surface, so that in use the base member can be embedded into a structure with said upper surface substantially flush with a surrounding upper surface portion of said structure.

9. A davit mount according to claim 8, wherein the base member includes a lower portion in which bolt receiving openings are formed, so that the base member can be secured to the structure by means of bolts which extend through said holes and connect the base member to said structure.

10. A davit mount according to claim 7, wherein the base member includes a border portion which extends about the periphery of the base member and projects upwardly above said upper surface, said mount further including a cover plate sized to fit within said border portion, said cover plate being of a thickness substantially equal to the height of the border portion above the upper surface of the base member.

11. A davit mount according to claim 7, wherein the first and second hook receiving openings are substantially rectangular in shape, are long and narrow, and are parallel to each other.

12. A davit mount according to claim 7, wherein said socket includes a pair of flanges extending laterally outwardly from the first and second sidewalls of the socket on the fourth side of the socket.

13. A davit mount according to claim 1, wherein said hook receiving openings each includes a hook engaging portion bordering opposite sides of such opening, so that the socket can be selectively mounted on the base member in either a first position with the hook members positioned below the hook engaging portions on one side of the hook receiving opening or in a second position with the hook members positioned below the hook engaging portions located on the opposite sides of the hook receiving openings.

14. A davit mount according to claim 13, wherein said lock means comprises a swing member located between the first and second sidewalls, said swing member having first and second ends, and hinge means pivotally connecting the first end of said hinge member to the first and second sidewalls at positions near the bottom and the front wall of the socket, for swinging movement of said swing member between an up position and a down position, said filler member being connected to said swing member at such a position that when the swing member is in its down position the filler member is snugly received in a hook receiving opening in the base member in the manner described.

15. A davit amount according to claim 14, wherein said socket includes a pair of flanges extending laterally outwardly from the first and second sidewalls of the socket on the fourth side of the socket.

16. A davit mount, comprising:

a base member formed to include a pair of spaced apart front and rear first and second hook receiving openings, said hook receivinng channel openings being substantially rectangular in shape, being long and narrow, and being parallel to each other, a support portion between the hook receiving openings and hook engaging portions bordering said hook receiving openings;

a mobile davit socket having first and second sidewalls spaced opposite each other, a front wall interconnected between the first and second sidewalls, a bottom, an open top, and a rear open fourth side, first hook means depending from the socket on the open fourth side of the socket, said first hook means including a first end wall which depends downwardly from the socket, and a first hook member which extends forwardly from said first end wall, and second hook means depending from the front wall the socket, said second hook means including a second end wall which extends downwardly from the socket, and a second hook member which extends downwardly from the socket, and a second hook member which extends laterally from said second end wall in the same direction as the first hook member, and away from the socket;

said hook receiving openings in the base member being sized and shaped to receive the hook members when said hook members are aligned with said hook receiving openings, so that the davit socket can be transported to the base member and the hook members put into alignment with the hook receiving openings in the base member, and the socket can be moved to insert the hook members through said hook receiving openings and place the bottom of the socket on the support portion of the base member between the hook receiving openings, and then the socket can be shifted in the direction that the hook members extend, to place the hook members below the hook engaging portions of the base member, said shifting movement creating an open space in the hook receiving opening into which the first hook member was inserted, rearwardly of the first end wall;

a swing member located between the first and second sidewalls, said swing member having first and second ends, and hinge means pivotally connecting the first end of said hinge member to the first and second sidewalls at positions near the bottom and the front wall of the socket, for swinging movement of said swing member between an up position and a down position; and a filler member connected to said swing member, said filler member being positioned such that when the swing member is in its down position the filler member is received within said space in the hook receiving opening which is positioned outwardly of the first end wall, and such filler member is in a position to block a shifting movement of the socket back into a position in which the hook members are in removal alignment with the hook receiving openings.

17. A davit mount according to claim 16, wherein said socket includes a pair of flanges extending laterally outwardly from the first and second sidewalls of the socket on the fourth side of the socket.

18. A davit mount according to claim 16, comprising securement pin receiving openings in the first and second sidewalls of the socket, for receiving securement pins used for securing a davit in place within the davit socket.

19. A davit mount according to claim 18, wherein the securement pin receiving openings include a first pair of openings which are in axial alignment with each other and which are positioned adjacent the fourth side of the socket, above the swing member when said swing member is in its down position, whereby a davit can be brought to the socket in a generally horizontal position, and its lower end can be inserted into the open fourth side of the socket, and a securement pin can be inserted through a first of said first pair of securement openings, then through a portion of the davit, and then through the second securement pin receiving opening of the pair, and then the davit can be swung upwardly about the securement pin, to place the davit in a substantially vertical position within the socket.

20. A davit mount according to claim 19, wherein said securement pin openings include a second pair of such openings in upper portions of the first and second sidewalls of the socket, for receiving a second securement pin after the davit has been placed in an upright position in the socket.

21. A method of mounting a socket onto a rooftop, comprising:

providing the rooftop with a base member having an upper surface set to be substantially flush with the portion of the rooftop surrounding the base member;

providing the base member with a pair of spaced apart front and rear first and second hook channel openings and hook engaging portions bordering said hook receiving openings;

providing a mobile davit socket which has first and second sidewalls spaced opposite each other, a front wall interconnected between the first and second sidewalls, a bottom, an open top, and a rear fourth side, first hook means depending from the socket on the fourth side of the socket, said first hook means including a first end wall which extends downwardly from the socket, and a first hook member which extends forwardly from said first end wall, towards the socket, and second hook means depending from the front wall of the socket, said second hook means including a second end wall which extends downwardly from the socket, and a second hook member which extends laterally from said second end wall in the same direction as the first hook member, and away from the socket;

providing a davit which includes a lower end portion sized to be received within said socket;

carrying the mobile davit socket to the base member;

placing the hook members on the mobile davit socket into alignment with the hook receiving opening in the base member;

moving the socket to insert the hook members through said hook receiving openings;

shifting the socket in the direction that the hook members extend, to place the hook members below the hook engaging portions of the base member;

locking the socket in said shifted position so that it will not shift back into a position in which the hook members are in removal alignment with the hook receiving openings;

bringing the davit to the davit socket;

placing the lower end of the davit into the socket, through the open fourth side of the socket;

swinging the davit upwardly into an upright position in the socket; and securing the davit to the socket so that it will remain in said upright position.

22. A method according to claim 21, comprising inserting a first securement pin through aligned openings in the first and second sides of the socket and a lower portion of the davit, and then swinging the davit up about said securement pin, and when the davit is in its upright position inserting at least one additional securement pin through aligned openings in upper portions of the first and second sidewalls of the socket, and the davit.

23. A method according to claim 21, comprising locking the socket into position by inserting a filler member into the hook receiving opening of the first end wall, in a position to flock a shifting movement of the socket back into a position in which the hook members are in removal alignment with the hook receiving openings.

24. A method according to claim 23, further comprising providing the mobile davit socket with a swing member which is located between the first and second sidewalls of said socket, said swing member having first and second ends, and providing hinge means pivotally connecting the first end of said edge member to the first and second sidewalls at positions near the bottom and the third wall of the socket, for swinging movement of said swing member between an up position and a down position, and positioning said filler member on said swing member at such a position that when the swing member is in its down position the filler member is received in a portion of a hook receiving opening positioned rearwardly from the first end wall; and inserting the hook members through the hook receiving openings of the base member with the swing member in an up position, then shifting said socket sideways to place the hook members below the hook engaging portions of the base member, and swinging the swing member downwardly to place the filler member into the hook receiving opening rearwardly of the first end wall, in the manner described.

* * * * *

UNITED STATES PATENT AND TRADEMARK OFFICE

CERTIFICATE OF CORRECTION

PATENT NO. : 4,714,226

DATED : December 22, 1987

INVENTOR(S) : Stephen E. Tracy

It is certified that error appears in the above-identified patent and that said Letters Patent are hereby corrected as shown below:

Below the Abstract, "22 claims" should read -- 24 claims --.

Column 1, line 13, before "davit mount", insert -- the --.

Column 4, line 6, "diagramatic" should be -- diagrammatic --.

Column 4, line 14, "diagramatic" should be -- diagrammatic --.

Column 8, line 19, "provides" should be -- provide --.

Column 9, line 29, "122, 194" should be -- 122, 124 --.

Claim 15, column 11, line 67, "amount" should be -- mount --.

Claim 16, column 12, line 6, before "openings", insert -- channel --.

Claim 16, column 12, line 6, "receivinng" should be -- receiving --.

Claim 16, column 12, line 22, after "wall", insert -- of -.

Claim 16, column 12, line 26, delete "laterally".

Claim 21, column 13, line 49, delete "towards the socket".

Claim 21, column 13, line 54, delete "laterally".

UNITED STATES PATENT AND TRADEMARK OFFICE

CERTIFICATE OF CORRECTION

PATENT NO. : 4,714,226

DATED : December 22, 1987

INVENTOR(S) : Stephen E. Tracy

It is certified that error appears in the above-identified patent and that said Letters Patent are hereby corrected as shown below:

Claim 21, column 14, line 6, after "socket", insert -- forwardly --.

Claim 23, column 14, line 31, after "opening", insert -- rearwardly --.

Claim 23, column 14, line 32, "flock" should be -- block --.

Claim 24, column 14, line 43, delete "third" and insert -- front -- therefor.

Claim 24, column 14, line 53, delete "sideways" and insert -- forwardly -- therefor.

Signed and Sealed this

Ninth Day of August, 1988

*Attest:*

*Attesting Officer*

DONALD J. QUIGG

*Commissioner of Patents and Trademarks*